US010208911B2

(12) United States Patent
Tanaka et al.

(10) Patent No.: US 10,208,911 B2
(45) Date of Patent: Feb. 19, 2019

(54) OPTICAL UNIT AND VEHICLE LAMP

(71) Applicant: Koito Manufacturing Co., Ltd., Tokyo (JP)

(72) Inventors: Hidetada Tanaka, Shizuoka (JP); Misako Nakazawa, Shizuoka (JP); Satoshi Yamamura, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 0 days.

(21) Appl. No.: 15/230,598

(22) Filed: Aug. 8, 2016

(65) Prior Publication Data

US 2016/0341388 A1 Nov. 24, 2016

Related U.S. Application Data

(63) Continuation of application No. PCT/JP2015/052851, filed on Feb. 2, 2015.

(30) Foreign Application Priority Data

Feb. 13, 2014 (JP) ..... 2014-025629

(51) Int. Cl.
*F21S 41/43* (2018.01)
*F21S 41/33* (2018.01)
(Continued)

(52) U.S. Cl.
CPC ..... *F21S 41/43* (2018.01); *F21S 41/147* (2018.01); *F21S 41/321* (2018.01);
(Continued)

(58) Field of Classification Search
CPC .. F21S 48/115; F21S 48/1159; F21S 48/1323; F21S 48/137; F21S 48/14;
(Continued)

(56) References Cited

U.S. PATENT DOCUMENTS

2007/0147062 A1* 6/2007 Nino ..... F21S 41/162 362/538
2013/0141928 A1* 6/2013 Puente ..... B60Q 1/0047 362/487
2014/0043805 A1* 2/2014 Yamamura ..... F21K 9/56 362/231

FOREIGN PATENT DOCUMENTS

CN 103133959 A 6/2013
CN 103492792 A 1/2014
(Continued)

OTHER PUBLICATIONS

International Search Report from International Application No. PCT/JP2015/052851, dated Apr. 14, 2015.
(Continued)

*Primary Examiner* — Anh Mai
*Assistant Examiner* — Nathaniel Lee

(57) ABSTRACT

An optical unit includes a light source, a rotary reflector that rotates about an axis of rotation and includes a reflective surface that reflects light emitted by the light source, and a projection lens including an incident surface on which reflected light from the rotary reflector is incident. A shade is provided between the projection lens and the rotary reflector. The shade blocks at least a portion of light that has been incident on an emission surface of the projection lens at an angle within a predetermined range, that has been condensed by the projection lens, and that travels toward the reflective surface of the rotary reflector.

3 Claims, 11 Drawing Sheets

(51) Int. Cl.

| | |
|---|---|
| ***F21S 41/40*** | (2018.01) |
| ***F21S 41/147*** | (2018.01) |
| ***F21S 45/43*** | (2018.01) |
| ***F21S 41/32*** | (2018.01) |
| ***F21S 41/675*** | (2018.01) |
| *F21S 41/255* | (2018.01) |
| *F21S 41/14* | (2018.01) |
| *F21S 45/47* | (2018.01) |
| *F21S 45/10* | (2018.01) |

(52) U.S. Cl.
CPC ..... *F21S 41/336* (2018.01); *F21S 41/40* (2018.01); *F21S 41/675* (2018.01); *F21S 45/43* (2018.01); *F21S 41/14* (2018.01); *F21S 41/255* (2018.01); *F21S 45/10* (2018.01); *F21S 45/47* (2018.01)

(58) Field of Classification Search
CPC .... F21S 48/1757; F21S 48/325; F21S 48/145; F21S 41/43; F21S 41/675; F21S 41/147; F21S 41/336; F21S 41/40; F21S 45/43
See application file for complete search history.

(56) References Cited

FOREIGN PATENT DOCUMENTS

| | | | | | |
|---|---|---|---|---|---|
| JP | H01-165501 | U | | 11/1989 | |
| JP | H04-357602 | A | | 12/1992 | |
| JP | 2008004512 | A | | 1/2008 | |
| JP | WO2012144143 | A1 | * | 10/2012 | ..... F21K 9/56 |
| JP | 2012-227102 | A | | 11/2012 | |
| JP | 2013-115046 | A | | 6/2013 | |
| WO | 2011-129105 | A1 | | 10/2011 | |

OTHER PUBLICATIONS

International Preliminary Report on Patentability from International Application No. PCT/JP2015/052851, dated Aug. 25, 2016.
Office Action for corresponding CN application No. 201580008470.5, (dated Dec. 21, 2017), SIPO.
Official Action on corresponding JP patent application No. 2015-562786, dated Aug. 14, 2018.
Official Action on corresponding CN patent application No. 201580008470.5, dated Sep. 7, 2018.

* cited by examiner

0 DEGREES

10 DEGREES

20 DEGREES

30 DEGREES

OPTICAL UNIT AND VEHICLE LAMP

CROSS-REFERENCE TO RELATED APPLICATIONS

This application is based upon and claims the benefit of priority from the prior Japanese Patent Application No. 2014-025629, filed on Feb. 13, 2014 and International Patent Application No. PCT/JP2015/052851, filed on Feb. 2, 2015, the entire content of each of which is incorporated herein by reference.

BACKGROUND OF THE INVENTION

1. Field of the Invention

The present invention relates to optical units and, in particular, relates to an optical unit used in a vehicle lamp.

2. Description of the Related Art

A vehicle lamp, provided with an optical unit including a rotary reflector that rotates unidirectionally about the axis of rotation while reflecting light emitted by a light source, is known (see JP2010-092124). The rotary reflector is provided with a plurality of blades arranged in the circumferential direction about the axis of rotation, and each blade is provided with a reflective surface by which the light is reflected to form a desired light-distribution pattern. Light reflected by the blades is projected toward the front of the vehicle lamp through a projection lens.

When a vehicle provided with a vehicle lamp such as the one described above travels during daytime, the sunlight incident on the lamp may be condensed by the projection lens onto the reflective surfaces of the blades of the rotary reflector, and the blades may melt and be damaged.

SUMMARY OF THE INVENTION

The present invention has been made in view of such an issue and is directed to providing a technique for preventing a blade from melting and being damaged by light incident on a projection lens and condensed thereby in an optical unit provided with a rotary reflector.

An optical unit according to an aspect of the present invention includes a light source; a rotary reflector that rotates about an axis of rotation and includes a reflective surface that reflects light emitted by the light source; and a projection lens having an incident surface on which reflected light from the rotary reflector is incident. A shade is provided between the projection lens and the rotary reflector, and the shade blocks at least a portion of light that has been incident on an emission surface of the projection lens at an angle within a predetermined range, that has been condensed by the projection lens, and that travels toward the reflective surface of the rotary reflector.

BRIEF DESCRIPTION OF THE DRAWINGS

Embodiments will now be described by way of examples only, with reference to the accompanying drawings which are meant to be exemplary, not limiting and wherein like elements are numbered alike in several Figures in which.

DETAILED DESCRIPTION OF THE INVENTION

An optical unit according to an aspect of the present invention includes a light source; a rotary reflector that rotates about an axis of rotation and includes a reflective surface that reflects light emitted by the light source; and a projection lens having an incident surface on which reflected light from the rotary reflector is incident. A shade is provided between the projection lens and the rotary reflector, and the shade blocks at least a portion of light that has been incident on an emission surface of the projection lens at an angle within a predetermined range, that has been condensed by the projection lens, and that travels toward the reflective surfaces of the rotary reflector.

According to this aspect, light to be condensed by the projection lens onto the reflective surfaces of the blades is blocked by the shade, and thus the blades can be prevented from melting and being damaged.

The shade may be provided at a position at which the shade does not block reflected light from the rotary reflector. This configuration makes it possible to eliminate an influence of the shade on a light-distribution pattern formed by the optical unit.

The shade may be made of metal. This configuration makes it possible to prevent the shade itself from melting and being damaged by the condensed light.

The invention will now be described by reference to the preferred embodiments. This does not intend to limit the scope of the present invention but to exemplify the invention. The size of the component in each figure may be changed in order to aid understanding. Some of the components in each figure may be omitted if they are not important for explanation.

(First Embodiment)

Figure 1:
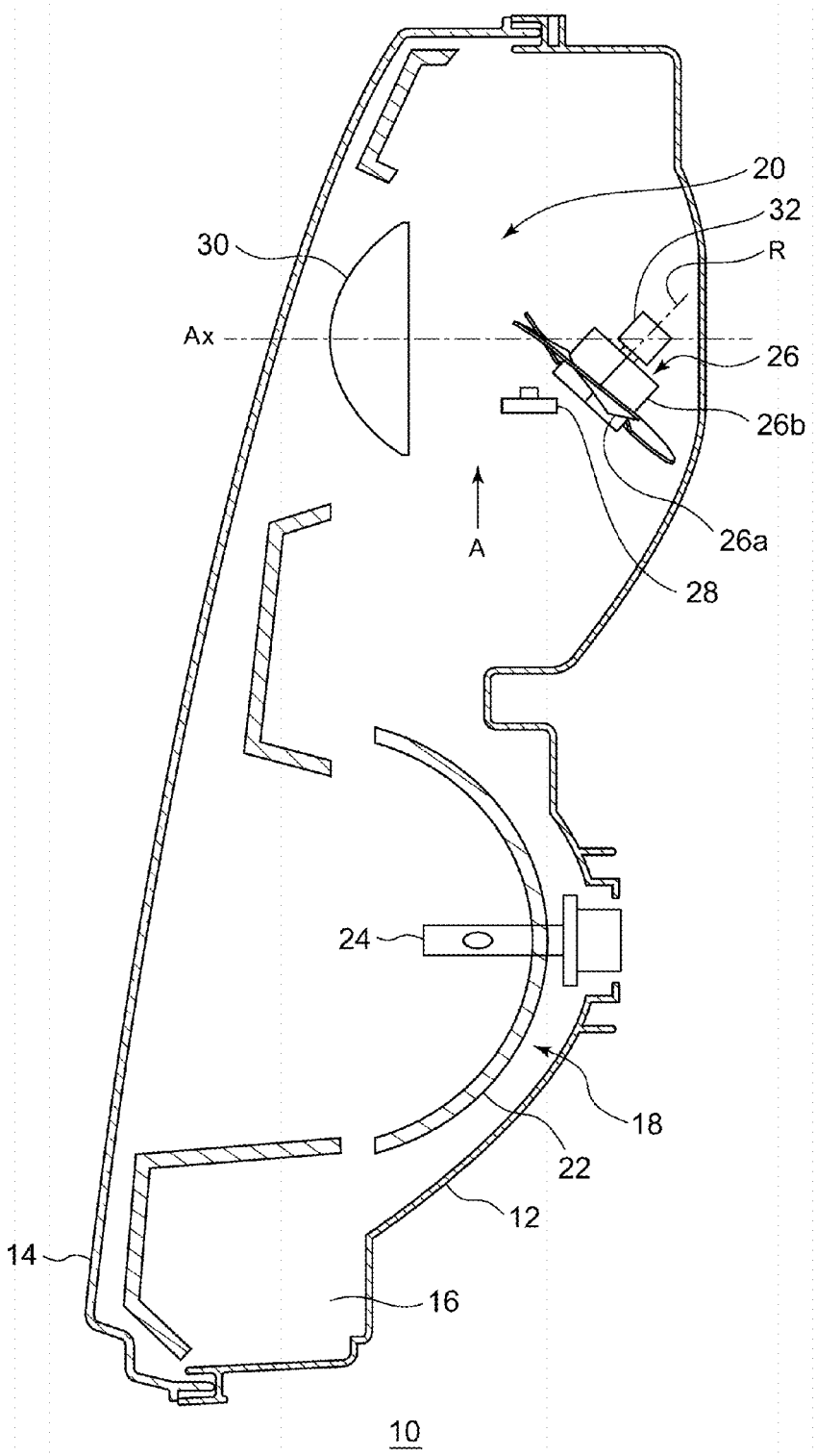
FIG. 1 is a horizontal sectional view of a vehicle headlamp according to a first embodiment.

FIG. 1 is a horizontal sectional view of a vehicle headlamp according to a first embodiment. A vehicle headlamp 10 is a right-side headlamp to be mounted on the front right side of an automobile and has the same structure as a headlamp to be mounted on the left side except that these headlamps are horizontally symmetrical. Therefore, the right-side vehicle headlamp 10 will be described in detail hereinafter, and the description of the left-side vehicle headlamp will be omitted.

As illustrated in FIG. 1, the vehicle headlamp 10 includes a lamp body 12 having a concave portion that opens toward the front side. The front opening of the lamp body 12 is covered by a transparent front cover 14, and thus a lamp room 16 is formed. The lamp room 16 functions as a space that houses two lamp units 18 and 20 disposed side by side in the widthwise direction of the vehicle.

The lamp unit on the outer side, or in other words, the lamp unit 20 illustrated in the upper side of FIG. 1 in the right-side vehicle headlamp 10 is a lamp unit that includes a lens and that is configured to illuminate with a variable high beam. Meanwhile, the lamp unit on the inner side, or in other words, the lamp unit 18 illustrated in the lower side of FIG. 1 in the right-side vehicle headlamp 10 is configured to illuminate with a low beam.

The low-beam lamp unit 18 includes a reflector 22, a light source bulb (incandescent bulb) 24 supported by the reflector 22, and a shade (not illustrated). The reflector 22 is supported by a known mechanism (not illustrated), such as a mechanism that uses an aiming screw and a nut, so as to be freely tilted relative to the lamp body 12.

As illustrated in FIG. 1, the lamp unit 20 includes a rotary reflector 26, an LED 28, and a convex lens 30 serving as a projection lens disposed in front of the rotary reflector 26. In place of the LED 28, a semiconductor light-emitting element, such as an EL element or an LD element, may be used as a light source. Alternatively, in place of the LED 28, a semiconductor laser or a light source that emits light by pumping a fluorescent body with a semiconductor laser may be used, or a combination of such a light source and an LED may be used as a light source. In particular, a light source that can be quickly turned on and off with high accuracy is preferable for carrying out control of blocking a portion of a light-distribution pattern, which will be described later. The shape of the convex lens 30 may be selected as appropriate in accordance with such light-distribution characteristics as required light-distribution pattern and illuminance distribution, and an aspherical lens or a free-form surface lens is used. In the present embodiment, an aspherical lens is used as the convex lens 30.

The rotary reflector 26 unidirectionally rotates about an axis of rotation R with a driving source 32, such as a motor. The rotary reflector 26 includes a reflective surface configured to reflect light emitted by the LED 28 to form a desired light-distribution pattern as the rotary reflector 26 rotates. In the present embodiment, the rotary reflector 26 constitutes an optical unit.

Figure 2:
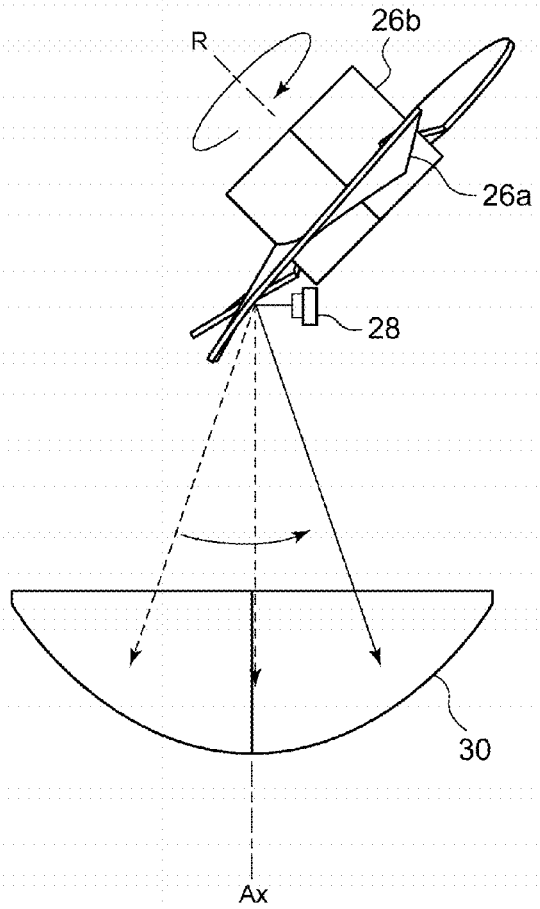
FIG. 2 is a top view schematically illustrating a configuration of a lamp unit that includes an optical unit according to the first embodiment.
Figure 3:
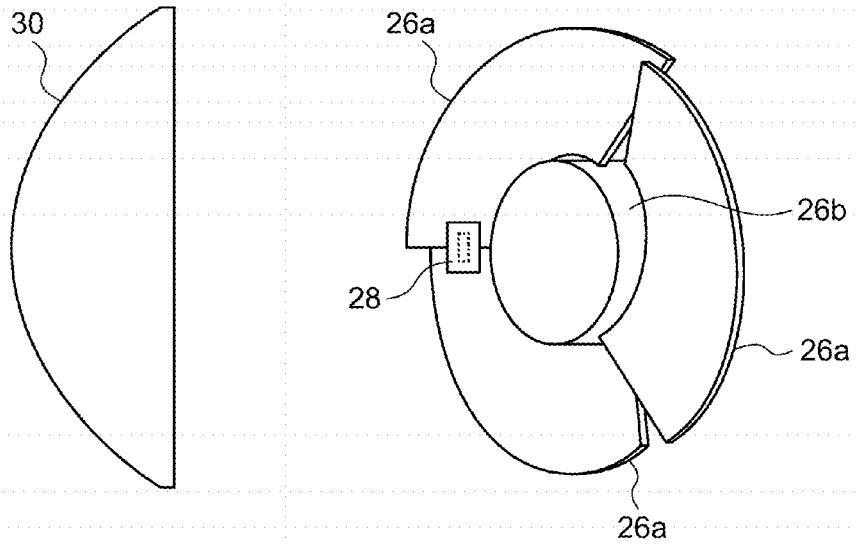
FIG. 3 is a side view of the lamp unit as viewed in the direction of an arrow A indicated in FIG. 1.

FIG. 2 is a top view schematically illustrating a configuration of the lamp unit 20 that includes the optical unit according to the present embodiment. FIG. 3 is a side view of the lamp unit 20 as viewed in the direction of an arrow A indicated in FIG. 1.

The rotary reflector 26 is provided with three blades 26*a* of an identical shape that function as reflective surfaces, and the blades 26*a* are provided on the circumference of a cylindrical rotation unit 26*b*. The axis of rotation R of the rotary reflector 26 is at an angle relative to an optical axis Ax and extends within a plane that contains the optical axis Ax and the LED 28. In other words, the axis of rotation R extends substantially parallel to the scanning plane of light (illumination beam) from the LED 28, which scans in the horizontal direction as the rotary reflector 26 rotates. Thus, the thickness of the optical unit can be reduced. The scanning plane can be seen, for example, as a fan-shaped plane formed by continuously connecting trajectories of the light from the LED 28 serving as scanning light. In the lamp unit 20 according to the present embodiment, the LED 28 provided therein is relatively small and is disposed at a position that is between the rotary reflector 26 and the convex lens 30 and that is offset from the optical axis Ax. Therefore, the size of the vehicle headlamp 10 in the depthwise direction (front and back direction of the vehicle) can be reduced as compared to a lamp unit of a conventional projector system in which a light source, a reflector, and a lens are disposed linearly along an optical axis.

Each blade 26*a* of the rotary reflector 26 is shaped such that a secondary light source of the LED 28 produced by reflection is formed near the focal point of the convex lens 30. In addition, each blade 26*a* has a twisted shape such that the angle formed by the optical axis Ax and the reflective surface changes along the circumferential direction with the axis of rotation being the center. This configuration enables the scan with the light from the LED 28 as illustrated in FIG. 2. This point will be described in further detail.

FIGS. 4A through 4E are perspective views, each illustrating the state of the blades corresponding to a given angle of rotation of the rotary reflector 26 in the lamp unit according to the present embodiment. FIGS. 4F through 4J are illustrations for describing a feature that the direction in which the light from the light source is reflected changes in accordance with the states illustrated in FIGS. 4A through 4E, respectively.

Figure 4A:
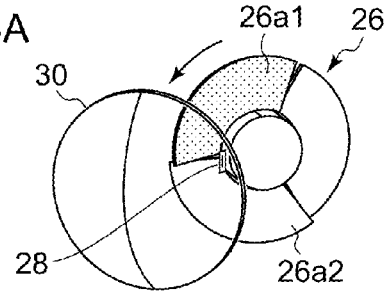
FIGS. 4A through 4E are perspective views each illustrating the state of blades corresponding to a given angle of rotation of a rotary reflector in the lamp unit according to the first embodiment.
Figure 4B:
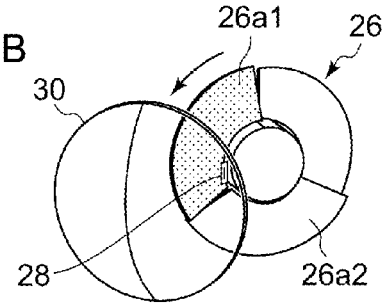

FIG. 4A illustrates a state in which the LED 28 is disposed to illuminate a boundary region between two blades 26*a*1 and 26*a*2. In this state, as illustrated in FIG. 4F, the light from the LED 28 is reflected by a reflective surface S of the blade 26*a*1 in a direction extending at an angle relative to the optical axis Ax. As a result, the light illuminates one of the right and left end portions of a region in front of the vehicle in which a light-distribution pattern is formed. Thereafter, the rotary reflector 26 rotates to enter the state illustrated in FIG. 4B. Then, the reflective surface S (reflection angle) of the blade 26*a*1 that reflects the light from the LED 28 changes because the blade 26*a*1 is twisted. As a result, as illustrated in FIG. 4G, the light from the LED 28 is reflected in a direction that is closer to the optical axis Ax than the reflection direction illustrated in FIG. 4F.

Figure 4C:
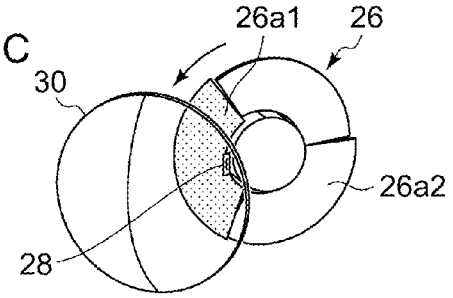
Figure 4D:
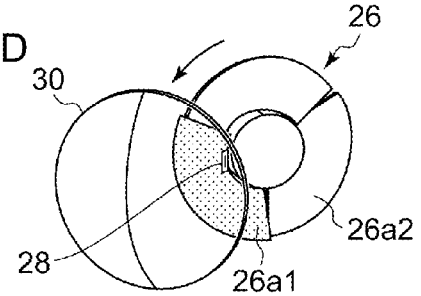
Figure 4E:
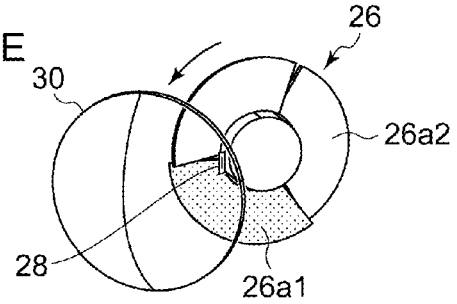
Figure 4F:
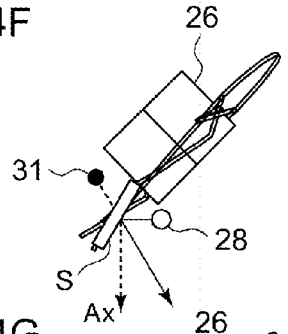
FIGS. 4F through 4J are illustrations for describing a feature that the direction in which light from a light source is reflected changes in accordance with the states illustrated in FIGS. 4A through 4E, respectively.
Figure 4G:
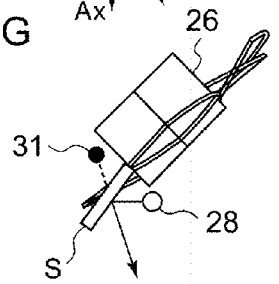
Figure 4H:
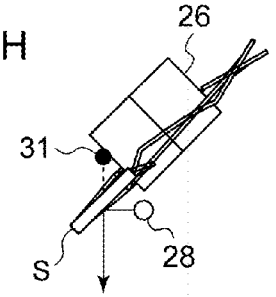
Figure 4I:
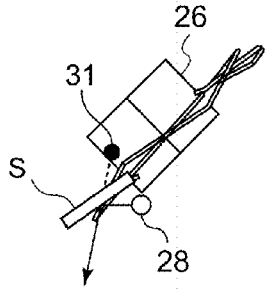
Figure 4J:
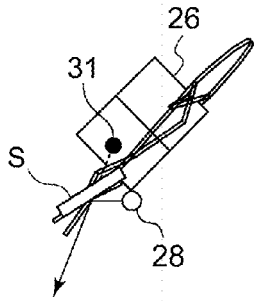
Figure 5A:
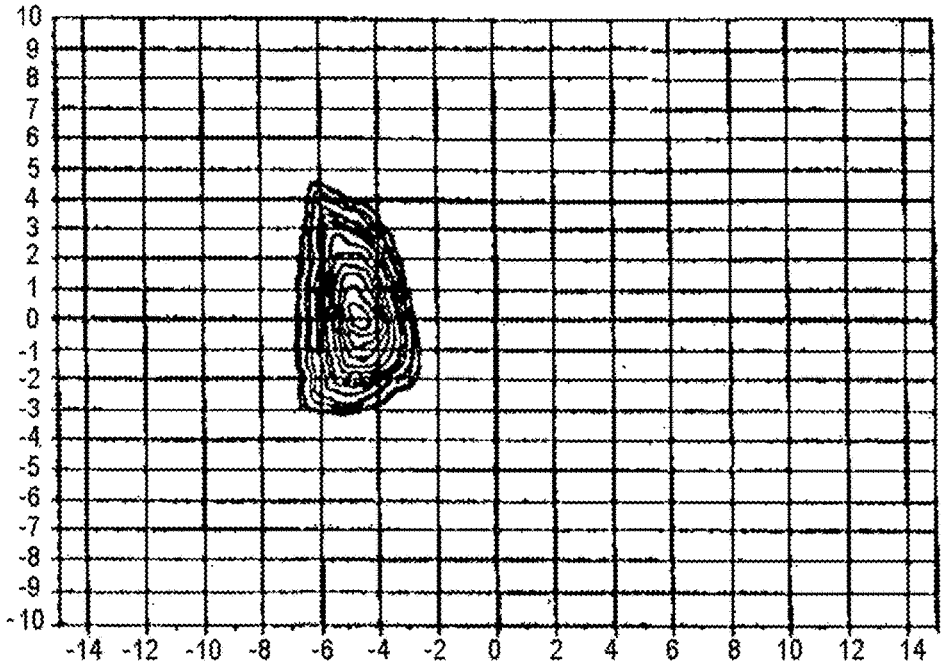
FIGS. 5A through 5E illustrate projection images obtained when the rotary reflector is at scanning positions corresponding to the states illustrated in FIGS. 4F through 4J, respectively.
Figure 5B:
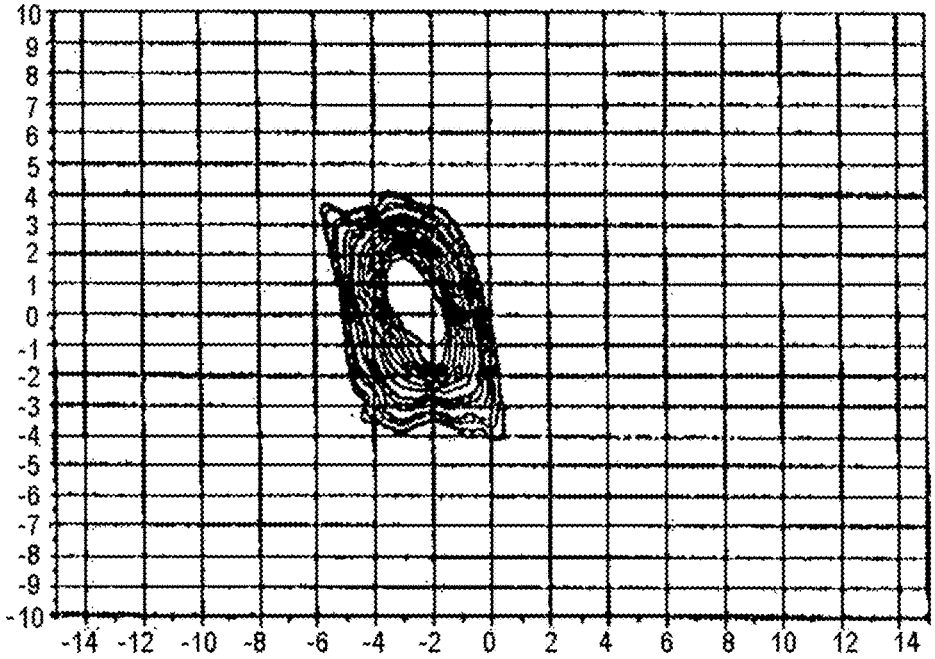
Figure 5C:
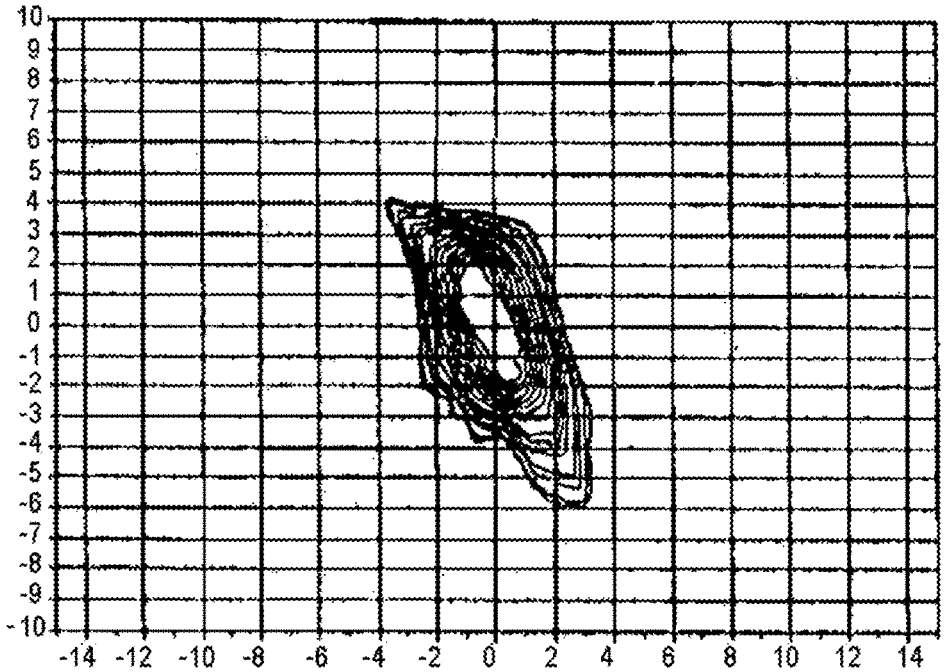
Figure 5D:
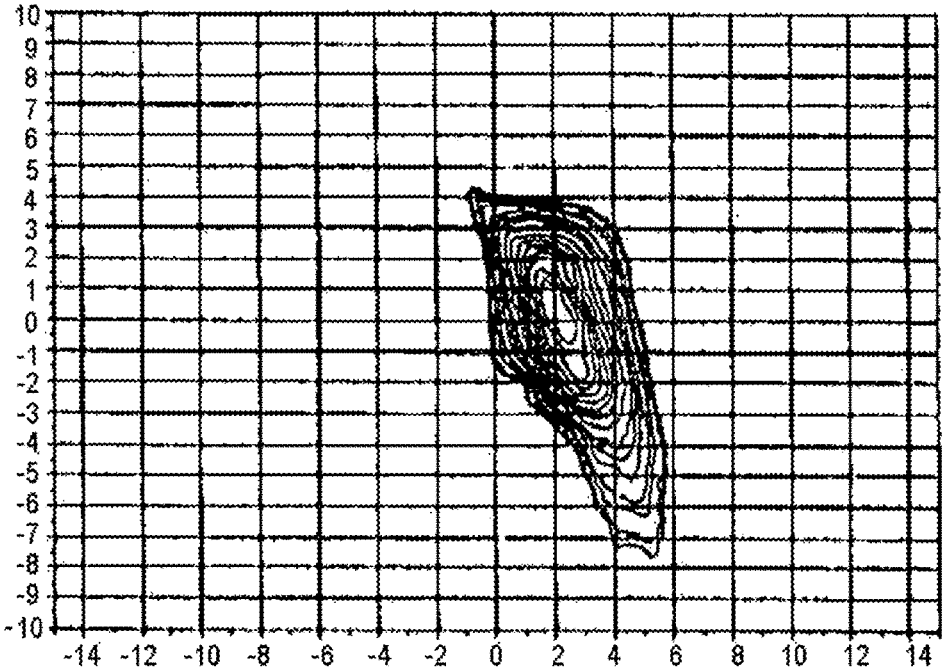
Figure 5E:
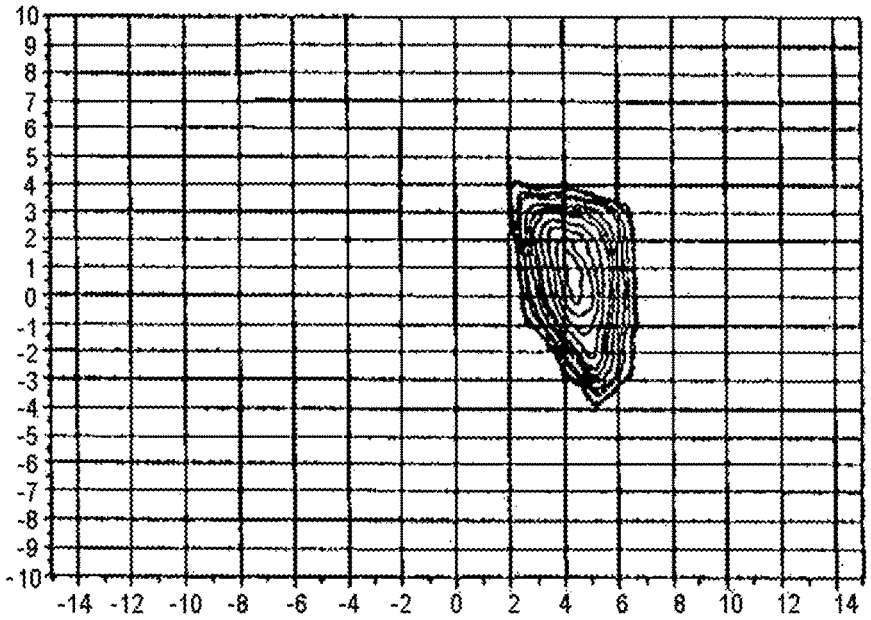

Subsequently, the rotary reflector 26 rotates as illustrated in FIGS. 4C, 4D, and 4E. Then, the direction in which the light from the LED 28 is reflected changes toward the other one of the right and left end portions of the region in front of the vehicle in which the light-distribution pattern is formed. The rotary reflector 26 according to the present embodiment can scan the front side once unidirectionally (in the horizontal direction) with the light from the LED 28 as the rotary reflector 26 rotates 120 degrees. In other words, a desired region in front of the vehicle is scanned once with the light from the LED 28 as a single blade 26*a* passes the front of the LED 28. As illustrated in FIGS. 4F through 4J, a secondary light source (light source virtual image) 31 moves horizontally near the focal point of the convex lens 30. The number of the blades 26*a*, the shape of each blade 26*a*, and the rotation speed of the rotary reflector 26 are set as appropriate on the basis of an experiment or a simulation result with the characteristics of a required light-distribution pattern or flicker of an image to be scanned taken into consideration. In addition, a motor is preferably used as a driving unit that can vary the rotation speed in accordance with various light distribution control. Thus, the scanning timing can be changed with ease. As such a motor, a motor that provides its own rotation timing information is preferable. Specifically, a DC brushless motor may be used. When a DC brushless motor is used, its rotation timing information can be obtained from the motor, and thus a device such as an encoder can be omitted.

In this manner, the rotary reflector 26 according to the present embodiment can scan the front of the vehicle in the horizontal direction with the light from the LED 28 by appropriately controlling the shape or the rotation speed of the blades 26*a*. FIGS. 5A through 5E illustrate projection images obtained when the rotary reflector is at scanning positions corresponding to the states illustrated in FIGS. 4F through 4J, respectively. The units on the vertical axis and the horizontal axis of the figures are degrees)(°), and the figures indicate irradiation ranges and irradiation positions. As illustrated in FIGS. 5A through 5E, the projection image moves in the horizontal direction as the rotary reflector 26 rotates.

Figure 6A:
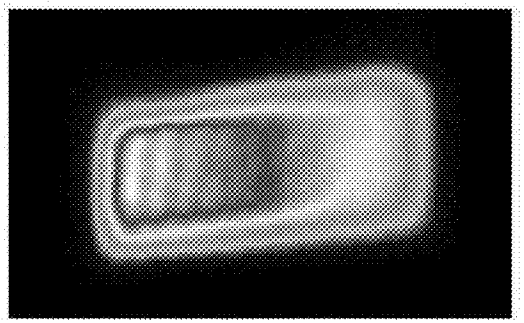
FIG. 6A illustrates a light-distribution pattern obtained when a range of ±5 degrees in the horizontal direction from the optical axis is scanned by using the vehicle headlamp according to the first embodiment.
Figure 6B:
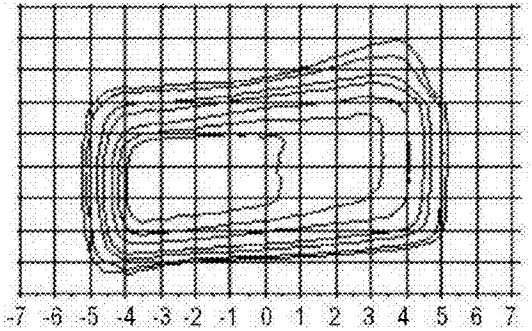
FIG. 6B illustrates a luminous intensity distribution of the light-distribution pattern illustrated in FIG. 6A.
Figure 6C:
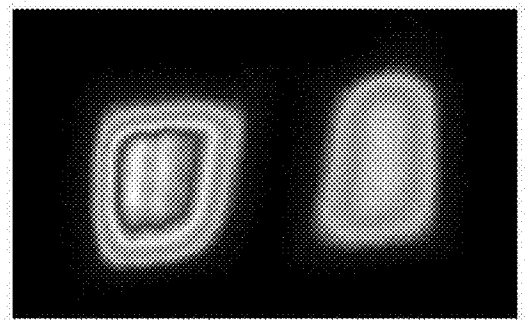
FIG. 6C illustrates a light-distribution pattern of which a portion is blocked by using the vehicle headlamp according to the first embodiment.
Figure 6D:
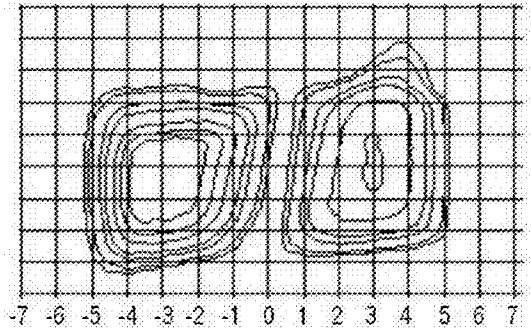
FIG. 6D illustrates a luminous intensity distribution of the light-distribution pattern illustrated in FIG. 6C.
Figure 6E:
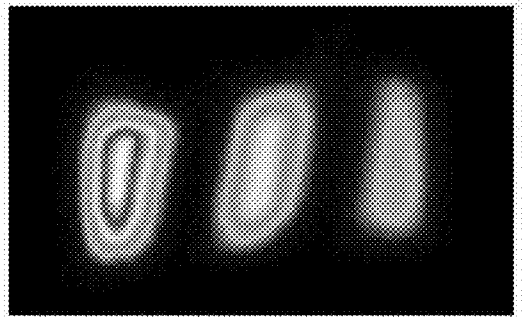
FIG. 6E illustrates a light-distribution pattern of which a plurality of portions are blocked by using the vehicle headlamp according to the first embodiment.
Figure 6F:
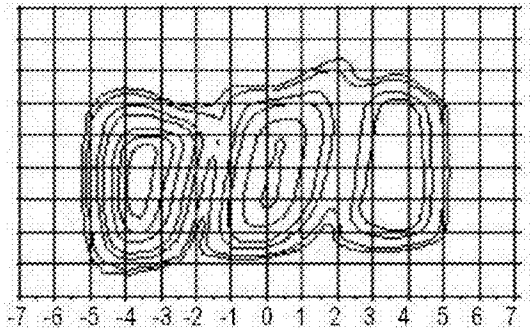
FIG. 6F illustrates a luminous intensity distribution of the light-distribution pattern illustrated in FIG. 6E.

FIG. 6A illustrates a light-distribution pattern obtained when a range of ±5 degrees in the horizontal direction from the optical axis is scanned by using the vehicle headlamp according to the present embodiment. FIG. 6B illustrates a luminous intensity distribution of the light-distribution pattern illustrated in FIG. 6A. FIG. 6C illustrates a light-distribution pattern of which a portion is blocked by using the vehicle headlamp according to the present embodiment. FIG. 6D illustrates a luminous intensity distribution of the light-distribution pattern illustrated in FIG. 6C. FIG. 6E illustrates a light-distribution pattern of which a plurality of portions are blocked by using the vehicle headlamp according to the present embodiment. FIG. 6F illustrates a luminous intensity distribution of the light-distribution pattern illustrated in FIG. 6E.

As illustrated in FIG. 6A, the vehicle headlamp 10 according to the present embodiment can form a substantially rectangular high-beam light-distribution pattern by reflecting the light from the LED 28 with the rotary reflector 26 and scanning the front with the reflected light. In this manner, a desired light-distribution pattern can be formed as the rotary reflector 26 rotates unidirectionally. Thus, driving of any specific mechanism, such as a resonance mirror, is not necessary, and there is no constraint on the size of the reflective surface as in a resonance mirror. Therefore, by employing a rotary reflector 26 having a larger reflective surface, light emitted by a light source can be used efficiently for illumination. In other words, the maximum luminous intensity in a light-distribution pattern can be increased. The rotary reflector 26 according to the present embodiment has a diameter that is substantially the same as the diameter of the convex lens 30, and the area of the blades 26*a* can be increased in accordance with the diameter of the convex lens 30.

The vehicle headlamp 10 that includes the optical unit according to the present embodiment can form a high-beam light-distribution pattern of which a desired region is blocked as illustrated in FIG. 6C or 6E by synchronizing the on/off timing of the LED 28 or a change in the light-emitting intensity with the rotation of the rotary reflector 26. When a high-beam light-distribution pattern is formed by changing the light-emitting luminous intensity of the LED 28 (turning on/off) in synchronization with the rotation of the rotary reflector 26, the light-distribution pattern itself can be swiveled by shifting the phase of the change in the luminous intensity.

As described thus far, the vehicle headlamp according to the present embodiment can form a light-distribution pattern by scanning with the light from the LED and form a blocked portion as desired at a portion of a light-distribution pattern by controlling the change in the light-emitting luminous intensity. Therefore, light in a desired region can be blocked with high accuracy with a small number of LEDs as compared to a case in which a blocked portion is formed by turning off some of a plurality of LEDs. In addition, the vehicle headlamp 10 can form a plurality of blocked portions, and thus even when a plurality of vehicles are present in front, light in regions corresponding to the respective vehicles can be blocked.

The vehicle headlamp 10 can control blocking of light without moving a basic light-distribution pattern, and thus a sense of discomfort from the driver can be reduced at the time of light-blocking control. In addition, a light-distribution pattern can be swiveled without moving the lamp unit 20, and thus the mechanism of the lamp unit 20 can be simplified. Therefore, it is sufficient that the vehicle headlamp 10 include, as a driving unit for variable light-distribution control, a motor necessary for rotating the rotary reflector 26, which can lead to a simple, low-cost, small-sized configuration.

(Second Embodiment)

Figure 7:
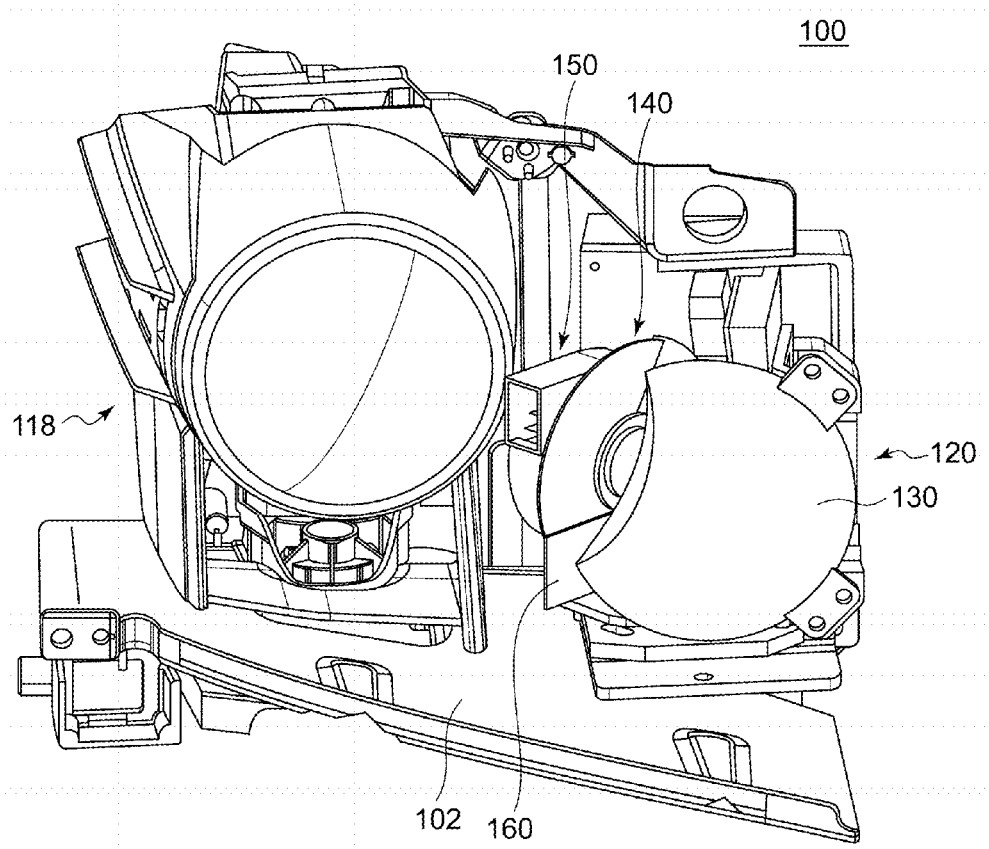
FIG. 7 is a schematic perspective view of a vehicle lamp according to a second embodiment.

FIG. 7 is a schematic perspective view of a vehicle lamp 100 according to a second embodiment as viewed from the upper left side. Similarly to the first embodiment, the vehicle lamp 100 is a right-side headlamp to be mounted on the front right side of an automobile.

The vehicle lamp 100 includes a lamp body 102 having a front opening, and the front opening is covered by a transparent front cover (not illustrated) to thus form a lamp room. In the lamp body 102, two lamp units 118 and 120 are disposed side by side in the widthwise direction of the vehicle.

The lamp unit 118 disposed on the outer side in the widthwise direction of the vehicle (left side in FIG. 7) is a lamp unit for forming a low beam that is constituted by a light source, a reflector having a reflective surface that reflects light emitted by the light source, and a projection lens. Such a lamp unit is well known, and thus detailed descriptions thereof will be omitted.

The optical unit 120 disposed on the inner side in the widthwise direction of the vehicle (right side in FIG. 7) is a lamp unit that includes a rotary reflector 140, similarly to the lamp unit 20 described in the first embodiment.

In addition to the lamp units 118 and 120, the vehicle lamp 100 may also be provided with a lamp unit of a different type.

Figure 9:
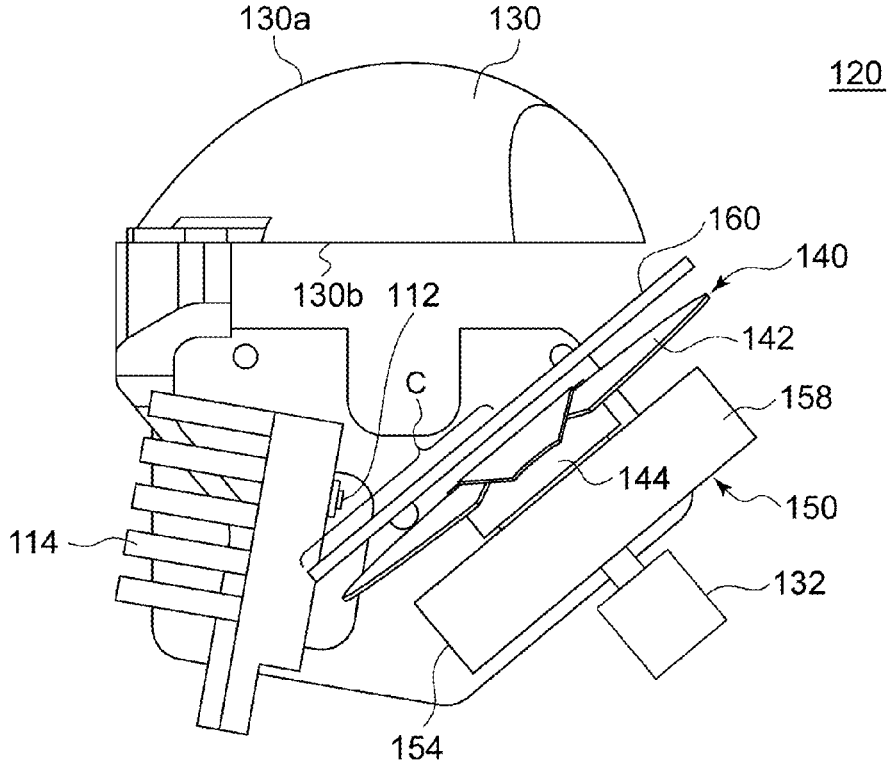
FIG. 9 is a top view of an optical unit illustrated in FIG. 7.
Figure 10:
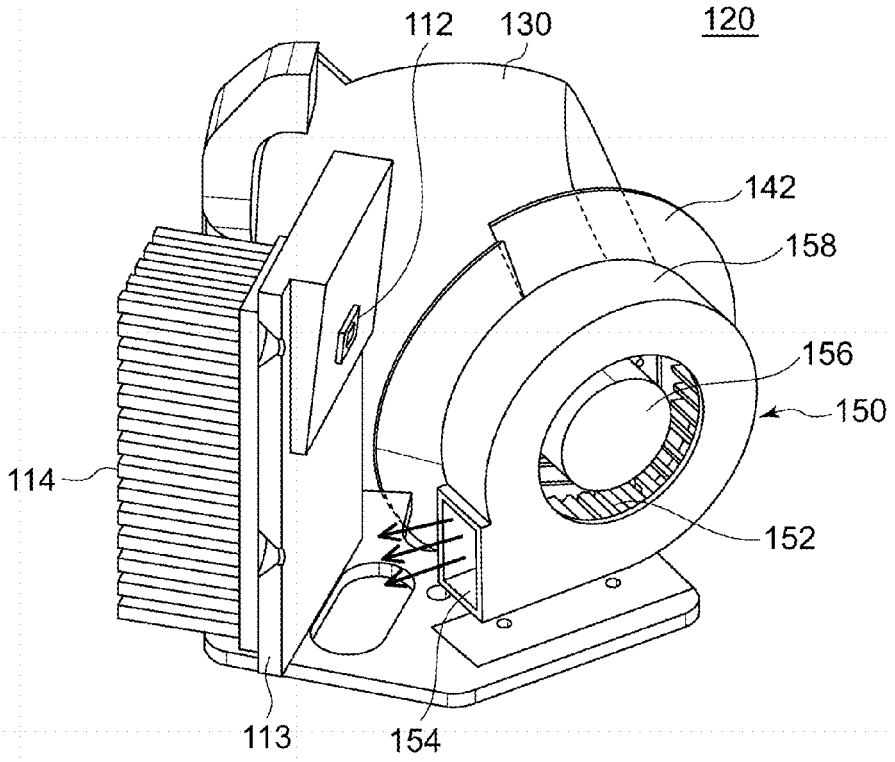
FIG. 10 is a perspective view of the optical unit illustrated in FIG. 7 as viewed from the rear side of the vehicle.

FIG. 9 is a top view of the optical unit 120 illustrated in FIG. 7, and FIG. 10 is a perspective view of the optical unit 120 as viewed from the rear side of the vehicle. The optical unit 120 includes the rotary reflector 140, an LED 112 serving as a light source, and a projection lens 130, which is a convex lens, disposed in front of the rotary reflector 140 and having incident surface 130*b* on which reflected light from the rotary reflector 140 is incident. In place of the LED 112, a semiconductor light-emitting element, such as an EL element or an LD element, may be used as a light source. Alternatively, a semiconductor laser or a light source that emits light by pumping a fluorescent body with a semiconductor laser may be used, or a combination of such a light source and an LED may be used as a light source.

As illustrated in FIGS. 9 and 10, a heat sink 114, for facilitating heat dissipation of the LED, is disposed behind the LED 112.

The shape of the projection lens 130 may be selected as appropriate in accordance with such light-distribution characteristics as required light-distribution pattern and illuminance distribution, and an aspherical lens or a free-form surface lens is used. In the present embodiment, a part of the projection lens 130 is cut out, which allows the rotary reflector to be seen from the front of the vehicle (see FIG. 7).

The rotary reflector 140 rotates unidirectionally about an axis of rotation with a driving source 132, such as a motor. The rotary reflector 140 includes a plurality of blades 142 (two in the present embodiment) having a reflective surface that reflects light emitted by the LED 112 to form a desired light-distribution pattern as the rotary reflector 140 rotates by a predetermined angle, and the blades 142 are provided in the circumferential direction of a cylindrical rotation unit 144. Similarly to the blades 26*a* of the rotary reflector 26 according to the first embodiment, each blade 142 is shaped such that a secondary light source produced by reflection is formed near the focal point of the projection lens 130. In addition, the blade 142 has a twisted shape such that the angle formed by the optical axis and the reflective surface changes along the circumferential direction with the axis of rotation being the center. The blade 142 is typically fabricated through plastic molding.

As described with reference to FIG. 6, the optical unit 120 can form a substantially rectangular high-beam light-distribution pattern by reflecting light from the LED 112 with the rotary reflector 140 and scanning the front with the reflected light.

A cooling fan 150 is provided on a side opposite to the reflective surface of the blades 142 of the rotary reflector 140. The cooling fan 150 is attached to the rotation unit 144 of the rotary reflector and is driven along with the rotary reflector 140 by the aforementioned motor. The cooling fan 150 is provided on a side opposite to the reflective surface of the blades, and thus the cooling fan 150 has no influence on a light-distribution pattern formed by the rotary reflector.

The cooling fan 150 is a so-called "blower fan" in which a multi-blade unit 156 is rotatably housed in a cylindrical housing 158. The multi-blade unit 156 shares the axis of rotation with the rotary reflector 140. The cooling fan 150 is configured to take in the air through an inlet 152 formed in the base of the housing 158 and to discharge the air compressed by the rotation of the multi-blade unit 156 through an outlet 154 formed in the side face of the housing 158. As a blower fan is used as the cooling fan, the airflow can be produced in a direction orthogonal to the axis of rotation of the rotary reflector. The airflow produced by the cooling fan 150 does not directly hit the rotary reflector 140, and thus the airflow has no influence on the number of rotations or the rotation speed of the rotary reflector. In addition, as the inlet 152 is disposed on a side opposite to the rotary reflector 140, the air can be taken in without being affected by the rotary reflector.

When a vehicle provided with the vehicle lamp 100 as described above travels in daytime, depending on the condition, the blades 142 of the rotary reflector 140 may melt and be damaged by the sunlight. This will be described with reference to FIGS. 11A through 11D.

FIGS. 11A through 11D illustrate trajectories of light rays obtained when the sunlight is incident on an emission surface 130*a* of the projection lens 130 of the optical unit 120. The height of the sun varies depending on the time, and thus the angle of incidence of the sunlight on the projection lens varies. FIGS. 11A, 11B, 11C, and 11D illustrate the trajectories of the light rays obtained when the light is incident at 0 degrees, 10 degrees, 20 degrees, and 30 degrees, respectively, relative to the horizon.

The light incident on the emission surface 130*a* of the projection lens 130 is condensed by the projection lens at a position around the posterior focal point. At this point, the position of the focal point relative to the projection lens varies depending on the angle of the incident light due to the curvature of field of the projection lens 130.

Figure 11A:
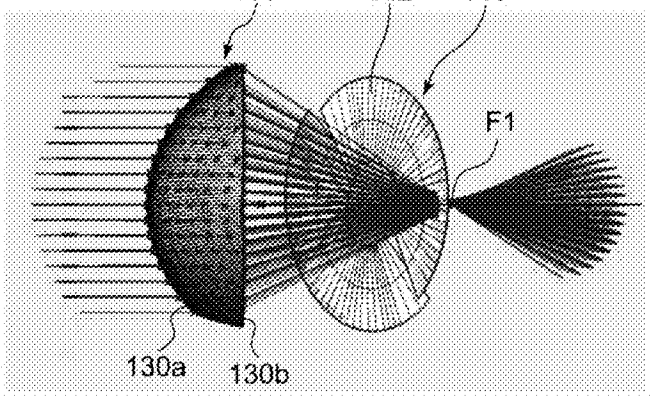
FIGS. 11A through 11D illustrate trajectories of light rays obtained when the sunlight is incident on an emission surface of a projection lens of an optical unit.
Figure 11B:
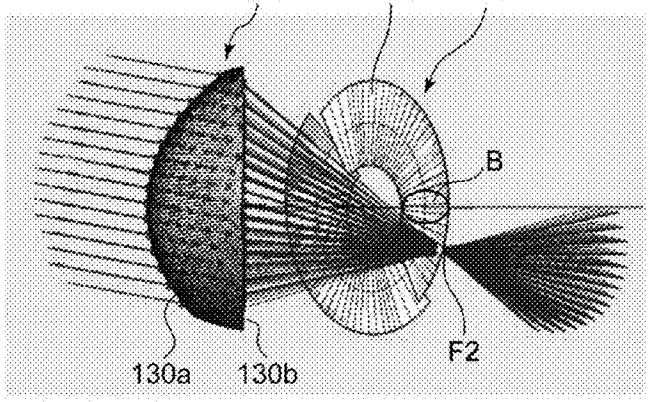

When the angle of the incident light is 0 degrees, as illustrated in FIG. 11A, a focal point F1 is located toward the rear side (right side in the figure) of the vehicle relative to the blade 142 of the rotary reflector 140. When the angle of the incident light is 10 degrees, as illustrated in FIG. 11B, the position of a focal point F2 approaches the blade 142.

Figure 11C:
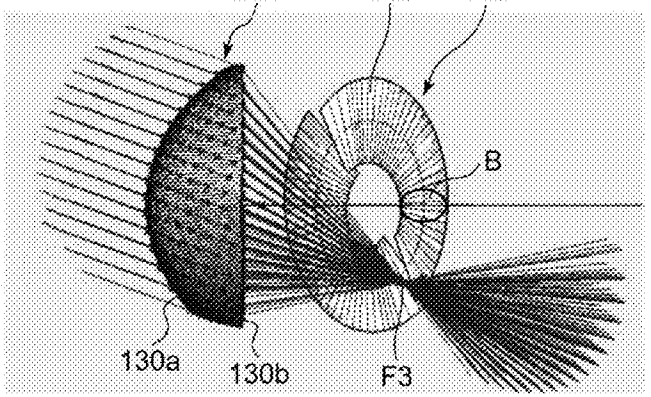
Figure 11D:
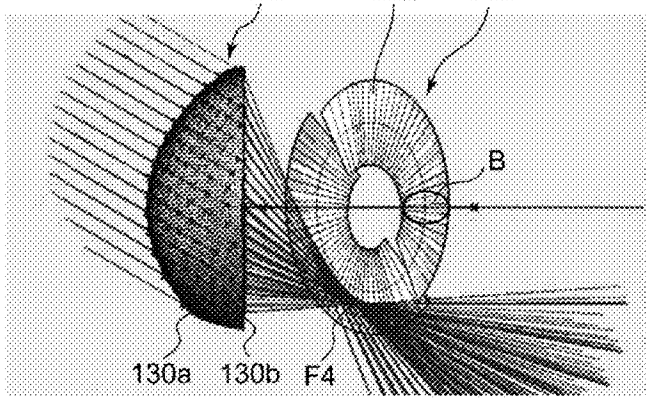

When the angle of the incident light is 20 degrees, as illustrated in FIG. 11C, a focal point F3 lies substantially on the reflective surface of the blade 142. When the angle of the incident light is located around this position, the energy of the sunlight concentrates on the reflective surface, and thus the blade 142, which is a plastic component, may melt and be damaged. When the angle of the incident light is 30 degrees, as illustrated in FIG. 11D, a focal point F4 moves to a position between the projection lens 130 and the rotary reflector 140, and thus the possibility that the blade 142 may melt and be damaged is eliminated.

Therefore, a blade can be prevented from melting and being damaged by blocking, of the light that is condensed by the projection lens 130 and travels toward the reflective surface of the blade of the rotary reflector, the light that travels toward the vicinity of the focal point F3 illustrated in FIG. 11C. Accordingly, in the present embodiment, as illustrated in FIGS. 7 and 9, a shade 160 is provided between the projection lens 130 and the rotary reflector 140.

By blocking the light that travels toward the vicinity of the focal point F3 with the shade 160, the blades 142 can be prevented from melting and being damaged by the light incident on the projection lens 130 and condensed thereby. It is preferable that the shade 160 be made of metal. This configuration makes it possible to prevent the shade 160 itself from melting and being damaged by the light condensed by the projection lens 130.

FIGS. 11A through 11D also illustrate a region B on the reflective surface of the blade 142. The region B is necessary for forming a desired light-distribution pattern by reflecting the light emitted by the LED 112 toward the projection lens 130 when the optical unit 120 is turned on. The above-described shade 160 may be provided at a position at which the shade 160 does not block the reflected light from the region B on the blade 142, and thus the shade 160 does not affect the light-distribution pattern formed by the optical unit 120.

In FIG. 9, the shade 160 is located immediately near the rotary reflector 140, and the length of the shade 160 is substantially the same as the diameter of the rotary reflector 140. The position and the shape of the shade 160, however, are not limited thereto. For example, the shade 160 may have a length indicated by C in FIG. 9, and the shade 160 can still prevent the blades from melting and being damaged by the condensed light at a sufficient level.

Figure 8:
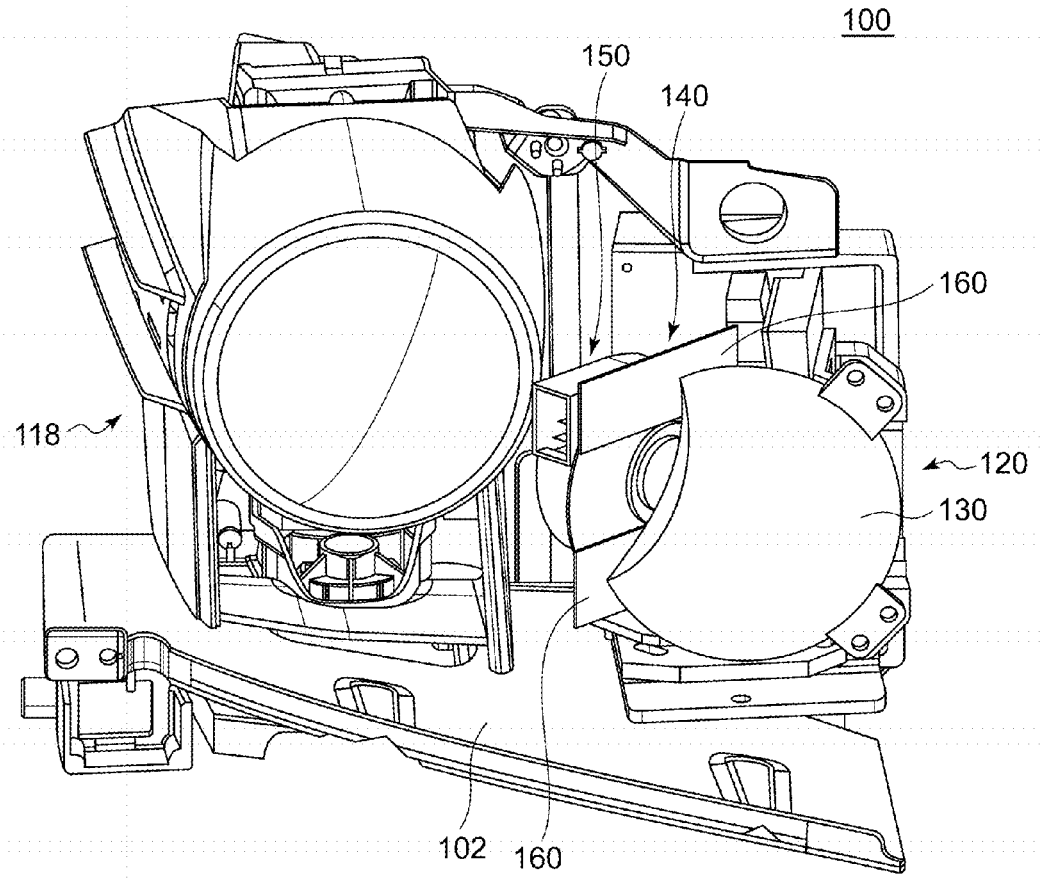
FIG. 8 is a schematic perspective view of another example of the vehicle lamp according to the second embodiment.

In addition, as illustrated in FIG. 8, the shade 160 may be provided on each of the upper side and the lower side of the rotary reflector 140.

The angles of the incident light described with reference to FIGS. 11A through 11 D are examples, and it is to be noted that the angular range of the incident light on the projection lens that could cause melting of and damage to the blades may change due to various factors including the shape of the projection lens and the mounting position of the vehicle lamp in the vehicle. This angular range may be determined through an experiment or a simulation.

Thus far, the present invention has been described with reference to the embodiments. The present invention, however, is not limited to the foregoing embodiments and encompasses an embodiment obtained by combining or replacing configurations of the embodiments as appropriate.

In the foregoing embodiments, a case in which the lamp unit is applied to a vehicle lamp has been described, but an application is not limited to this field. For example, the lamp unit may also be applied to a lighting device for a stage or an entertainment facility in which lighting is carried out while switching various light-distribution patterns.

What is claimed is:

1. An optical unit, comprising:

a light source;

a rotary reflector that rotates about an axis of rotation and includes a reflective surface that reflects light emitted by the light source;

a projection lens having an incident surface on which reflected light from the rotary reflector is incident; and a shade provided between the projection lens and the rotary reflector, the shade blocking at least a portion of light that has been incident on an emission surface of the projection lens at an angle within a predetermined range, that has been condensed by the projection lens, and that travels toward the reflective surface of the rotary reflector and wherein the shade is configured such that the shade simultaneously does not block reflected light from the rotary reflector.

2. The optical unit according to claim 1, wherein the shade is made of metal.

3. A vehicle lamp, comprising:

the optical unit according to claim 1.

* * * * *